US005562049A

United States Patent [19]

Hoffman et al.

[11] Patent Number: 5,562,049

[45] Date of Patent: Oct. 8, 1996

[54] TABLE WITH EXTENDABLE AND ROTATABLE SURFACES AND MECHANISM FOR SAME

[75] Inventors: D. Stephen Hoffman, High Point, N.C.; J. Steven Helton, Morrison, Tenn.

[73] Assignees: Helton, Inc., Morrison, Tenn.; Ultra-Mek, Inc., Denton, N.C.

[21] Appl. No.: 294,322

[22] Filed: Aug. 23, 1994

[51] Int. Cl.[6] ..... A47B 57/00

[52] U.S. Cl. ..... 108/94; 297/188.17; 297/145

[58] Field of Search ..... 108/138, 141, 108/139, 142, 93, 94, 140; 297/188.17, 188.16, 145; 248/282, 277, 922, 920

[56] References Cited

U.S. PATENT DOCUMENTS

| | | | |
|---|---|---|---|
| 1,659,572 | 2/1928 | Klemm | 108/94 X |
| 2,118,620 | 5/1938 | Orsenigo | 108/140 X |
| 2,859,803 | 11/1958 | McCallister . | |
| 3,583,760 | 6/1971 | Mcgregor | 297/145 |
| 3,632,157 | 1/1972 | Lohr . | |
| 4,194,452 | 3/1980 | Crowther et al. | 108/138 |
| 4,546,708 | 10/1985 | Wilburth | 108/94 |
| 4,644,875 | 2/1987 | Watt | 108/93 |
| 4,685,729 | 8/1987 | Heesch et al. . | |
| 4,687,167 | 8/1987 | Shalka et al. | 108/142 X |
| 4,986,589 | 1/1991 | McNew . | |
| 5,064,244 | 11/1991 | Sproule . | |
| 5,106,153 | 4/1992 | Durling . | |
| 5,193,765 | 3/1993 | Simpson et al. | 297/145 X |
| 5,249,533 | 10/1993 | Moore, III | 108/138 X |
| 5,282,671 | 2/1994 | Funk | 297/145 X |

*Primary Examiner*—José V. Chen

*Attorney, Agent, or Firm*—Seltzer; Park and Gibson, P.A. Bell

[57] ABSTRACT

A table having a pair of laterally extendable table surfaces. The table includes a base having a horizontally disposed periphery that defines a footprint on an underlying surface, first and second generally planar table surfaces, a table surface forward extension mechanism interconnected with the base and the first and second table surfaces, and a table surface lateral extension mechanism interconnected with the base and the first and second table surfaces. The table surface forward extension mechanism and the table surface lateral extension mechanism are each constructed and arranged so that each of the first and second table surfaces is movable between a retracted position, in which the first and second table surfaces are positioned generally above the base footprint, and a laterally extended position, in which the major portions of the first and second table surfaces are generally horizontally disposed and are positioned above, forwardly and laterally of the base footprint. In this laterally extended position, the table surfaces provide a table-like support surface to occupants of laterally positioned adjacent seating units. In one embodiment, the table is included in a "side-by-side" furniture unit that includes a pair of seating units having a storage console attached therebetween. In this embodiment, the table of the present invention extends to provide usable table surfaces to the occupants of the attached seating units.

37 Claims, 8 Drawing Sheets

TABLE WITH EXTENDABLE AND ROTATABLE SURFACES AND MECHANISM FOR SAME

FIELD OF THE INVENTION

The present invention relates generally to tables, and relates more specifically to tables having movable support surfaces.

BACKGROUND OF THE INVENTION

Many homes have multiple seating units, such as chairs and sofas, residing and arranged in a living room or den. With the trend toward increased use of the living room or den as a recreational, entertainment and dining space, many consumers desire furniture pieces that provide function beyond the conventional seating and support provided by conventional furniture. An early example of such furniture is the so-called "recliner" chair, which is a chair that moves from an upright position to one or more reclined positions that are particularly suitable for sleeping, reading, and watching television. As another example of furniture having added function, coffee tables and end tables have been developed that have the appearance of conventional tables but that provide a movable table surface; these tables are particular appealing for those who wish to eat, read, play cards or games, or engage in other activities that would benefit from having a table-like surface positioned as a tray for a seated occupant.

In addition, some pieces have been developed that provide multiple functions. For example, U.S. Pat. No. 5,106,153 to Durling discusses a unit of furniture that comprises a pair of recliner chairs having a storage console positioned therebetween. In this configuration, the unit provides reclining capability for two occupants at the same time and also provides a storage receptacle for reading material, video and audio tapes, snack foods, and remote control devices for a television, video recorder or player, or the like, and provides this storage receptacle in a location convenient to each seated occupant.

This unit has some recognized shortcomings. It is constructed, sold, and used as a single piece; thus it is quite bulky and cannot be broken down into smaller pieces to fit advantageously within a small room. As a result, the unit cannot be used in rooms in which there is insufficient space to contain the entire unit. It is also not designed for use with only a single chair, or with a pair of chairs that are unmatched in style, reclining capability, upholstery, and the like. It cannot be used in the disclosed configuration with recliner chairs in which the armrests of the chair move relative to the base during the reclining motion. In addition, some consumers dislike its bulky appearance. Finally, the unit provides a storage receptacle, but does not provide a convenient table-like support surface for supporting materials such as food, beverages, books, and magazines. The console includes a cover hingedly attached to its rear wall, but the cover must be raised to access the storage cavity of the console and thus cannot be used to support articles while the storage is being accessed.

In view of the foregoing, it is an object of the present invention to provide a unit which provides a convenient table-like support surface for a furniture unit that includes a pair of chairs having a storage receptacle therebetween.

It is also an object of the present invention to provide a table having a support surface that can be used one or two chairs.

It is an additional object of the present invention to provide a table having table-like support surfaces that can be used with two adjacent chairs irrespective of the structure and style of the chairs.

It is a further object of the present invention to provide a table-like support that permits access to an associate storage console.

It is another object of the present invention to provide a table that can be used with a pair of adjacent chairs that can be packaged and shipped separately from the chairs.

SUMMARY OF THE INVENTION

These and other objects are satisfied by the present invention, which provides a table having a pair of laterally extendable table surfaces. The table comprises a base having a horizontally disposed periphery that defines a footprint on an underlying surface, first and second generally planar table surfaces, table surface forward extension means interconnected with the base and the first and second table surfaces, and table surface lateral extension means interconnected with the base and the first and second table surfaces. The table surface forward extension means and the table surface lateral extension means are each constructed and arranged so that each of the first and second table surfaces is movable between a retracted position, in which the first and second table surfaces are positioned generally above the base footprint, and a laterally extended position, in which the major portions of the first and second table surfaces are generally horizontally disposed and are positioned above, forwardly and laterally of the base footprint. In this laterally extended position, the table surfaces provide a table-like support surface to occupants of laterally positioned adjacent seating units. Such laterally positioned seating units can include those found in residences or others, such as those in automobiles, trains, airplanes, busses, vans, and the like.

In one embodiment, the table is included in a "side-by-side" furniture unit that includes a pair of seating units having a storage console attached therebetween. In this embodiment, the table of the present invention extends to provide usable table surfaces to the occupants of the attached seating units. In a similar embodiment, the table of the present invention includes means for interconnecting one or more seating units thereto; this provides the occupant with the option of connecting the table to the seating unit or using it as a "stand-alone" unit.

DETAILED DESCRIPTION OF THE INVENTION

The present invention will now be described in greater detail hereinbelow with reference to the accompanying drawings. The invention is not intended to be limited to the embodiments described and illustrated herein; rather, these embodiments are included to convey to the scope of the invention to one skilled in this art.

This invention is directed to tables that have a stationary base and a pair of table surfaces that move to one or more positions (upward, forward, and lateral) from a retracted position generally above the base to provide usable raised table surfaces for the occupants of adjacent chairs or sofas. In the description that follows, the positional relationships between structures of the table are described using the following terms. As used herein, the terms "front," "forward," and derivatives thereof refer to the direction defined by a vector extending parallel to the table surfaces of the table in the direction the table surfaces move in moving from the retracted to the extended positions. Conversely, the term "rearward" and derivatives thereof refer to the direction directly opposite the forward direction; i.e., that direction defined by a vector extending parallel to the table surfaces in the direction the table surfaces move in retracting from the extended positions to the retracted position. The terms "lateral" and derivatives thereof and "outward" and derivatives thereof refer to the direction defined by a vector originating in the center of one of the table surfaces and extending in the plane of the table surface perpendicular to the forward and rearward directions. The terms "inboard," "inward," and "inwardly" refer to the direction directly opposite to the direction defined above as "lateral."

Figure 1:
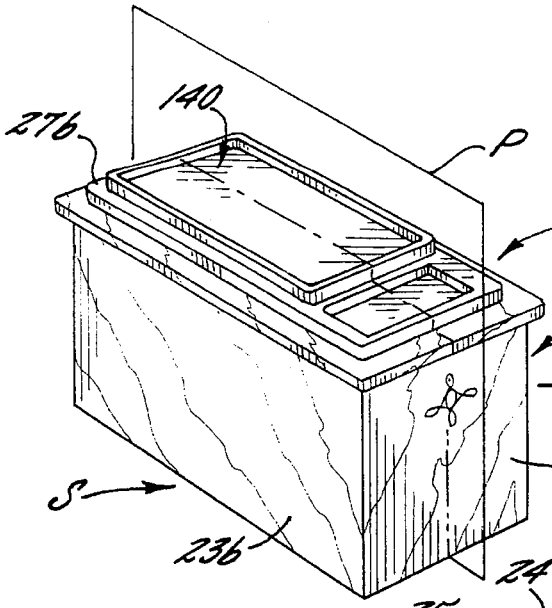
FIG. 1 is a perspective view of a table of the present invention with the table surfaces in the retracted position.

Referring now to the drawings, FIG. 1 shows a table, designated broadly at 20, comprising a base 21, a pair of extendable, swivelable tables 130, 140, and a pair of mechanisms 30*a*, 30*b* (FIG. 3) that interconnect the table surfaces 130, 140 with the base 21. The base 21 comprises a front wall 22, a pair of lateral walls 23*a*, 23*b*, a rear wall 25, and a floor (not shown) which are fixed to one another to form a rectangular box. The walls 22, 23*a*, 23*b* and 25 form the horizontally-disposed periphery of the base 21, the downward projection of which defines a footprint on the underlying surface S directly beneath the base. Those skilled in this art will recognize that the horizontally-disposed periphery, and thus the footprint defined thereby can take a number of configurations, such as square, rectangular, oval, elliptical, circular, and the like, and still be suitable for use with the present invention.

A storage bin 24 resides within and lines the cavity of the base 21. The bin 24 is secured to the front and rear walls 22, 25 via threaded fasteners (not shown). The bin 24 can be configured to include storage recesses for items, such as television, video cassette recorder, and stereo remote control devices, videocassettes, magazines, books, and the like, that can be stored within the bin 24. Although the inclusion of a bin 24 is preferred, those skilled in this art will recognize that the bin can be omitted entirely and the cavity formed by the walls 22, 23, 25 and the floor of the base 21 can be utilized as storage space. Mounting rails 27*a*, 27*b* are fixed to and extend from the front wall to the rear wall 25 to provide mounting supports for the mechanisms 30*a*, 30*b*.

As stated above, the table 20 includes a pair of four-bar linkage mechanisms 30*a*, 30*b* that control the movement of the table surfaces 130, 140 between the retracted position (FIGS. 1, 4 and 6), in which the table surfaces 130, 140 are positioned generally above the base footprint, and their respective unrotated extended positions (FIGS. 3, 7 and 8) in which the major portions of the table surfaces 130, 140 are positioned above, forwardly, and inwardly from the periphery of the base footprint. As used herein, "four-bar linkage" refers to a hinged chain of links of having one rotational degree of freedom and equivalent structures, such as slider-crank mechanisms, see, e.g., Paul, *Kinematics and Dynamics of Planar Machinery* (Prentice-Hall, Inc., Englewood Cliffs, N.J. 1979), and is intended to encompass mechanical configurations having multiple interconnected four-bar linkages.

Each of the mechanisms 30*a*, 30*b* (FIGS. 3 and 4) comprises a mounting bracket 31, a rear pivot link 40, a front pivot link 50, and a table surface mounting bracket 60. The mechanisms 30*a*, 30*b* are mirror images of each other about a plane of symmetry P (indicated in FIG. 1) that is normal to the table surfaces 130, 140 and parallel to and located equidistant from the lateral walls 23*a*, 23*b* of the base 21. In the interest of brevity and clarity, only one mechanism 30*a* will be described in detail herein; those skilled in this art will understand that the description of this linkage applies equally to the mirror image mechanism 30*b* thereof.

The base mounting bracket 31 (FIGS. 3 and 7) includes a horizontal plate 32 and a vertical plate 33. The horizontal plate 32 is substantially flat and is attached to the underside of the rail 27*a* via threaded fasteners 35, which are inserted through apertures 34 located in the horizontal plate 32. The vertical plate 33 is fixed substantially perpendicularly to the inwardmost edge of the horizontal plate 32 and extends downwardly therefrom. A rear spring pin 36 is fixed to and extends outwardly from the rearmost outward surface of the vertical plate 33. The mounting bracket 31 also includes an aperture 46 positioned at the forwardmost portion of the vertical plate 33 for receiving a pivot pin 52, and further includes an aperture 39 positioned rearwardly and slightly downwardly of the aperture 46 for receiving a pivot pin 37. Although pivot pins are illustrated herein, those skilled in this art will appreciate that these and other pivotal interconnections described and illustrated herein can be provided by other structures, such as rivets, bolts, screws, and the like. In addition, an inwardly-extending stop pin 43 is fixed to the inboard surface of the vertical plate 32.

Those skilled in this art will appreciate that, although the base mounting bracket 31 is illustrated herein and is preferred, any means that mounts and pivotally interconnects the mechanism 30*a* to the base 21 is suitable for use with this invention. Exemplary alternatives include direct pivotal attachment of the pivot links 40, 50 to the base 21, separate mounting brackets for the pivot links 40, 50 that are attached to the base 21, and the like.

The rear pivot link 40 (FIGS. 3 and 4) comprises a body link 41 and a spring extension arm 45. The body link 41 includes an aperture 47 for pivotal interconnection to the base mounting bracket 31 via the pivot pin 37, and further includes an aperture 48 for pivotal interconnection to the table surface mounting bracket 60 via a pivot pin 44. The spring extension arm 45 is fixed substantially perpendicularly to the lower portion of the body link 41 to form a vertex that coincides with the aperture 47. A forward spring pin 42 is fixed to the outward surface of the spring extension arm 45 at the end thereof opposite the aperture 47 and extends outwardly therefrom. The forward spring pin 42 extends laterally to receive a spring 38, which is attached at its opposite end to the rear spring pin 36. Those skilled in this art will appreciate that the body link 41 of the rear pivot link 40 can be straight (as seen in side view in FIG. 3), as is illustrated and preferred, or can take other nonlinear configurations if appearance or function dictates.

The front pivot link 50 (FIGS. 3 and 4) includes an aperture 54 at one end for pivotal interconnection to the base mounting bracket 31 through the pivot pin 52, and further includes an aperture 55 at its opposite end for pivotal interconnection to the table surface mounting bracket 60 through a pivot pin 61. At its lowermost portion near the aperture 54, the front pivot link is fixed to a lower cross-brace 53 of hollow square cross-section that extends to a fixed attachment at the corresponding position on the front pivot link of the mechanism 30*b* on the opposite side of the table 20. As is the case for the rear pivot link 40, the front pivot link 50 is illustrated as being substantially straight when viewed from the side, which is the preferred configuration, but it can take other nonlinear configurations if appearance or function so dictate.

The table mounting bracket 60 (FIGS. 3 and 4) comprises a horizontal plate 63 and a vertical plate 64. The vertical plate 64 is fixed perpendicularly to and extends downwardly from the lateralmost edge of the horizontal plate 63. The vertical plate 64 includes an aperture 66 at its rearmost portion for pivotal interconnection to the rear pivot link 40 through pivot pin 44, and further includes an aperture 67 positioned upwardly and forwardly of the aperture 66 for pivotal interconnection to the front pivot link 50 through the pivot pin 61. A stop pin 69 extends upwardly from the forward portion of the horizontal plate 63. Also, a rivet aperture 89 is positioned forwardly of the stop pin 69. Those skilled in this art will appreciate that, although the table surface mounting bracket 60 is illustrated herein and is preferred, any means that mounts and pivotally interconnects the front pivot link 50 and the rear pivot link 40 with the table surfaces 130, 140 is suitable for use with this invention. Exemplary alternatives include direct pivotal attachment of these links to a downwardly projecting rib of the table surface, separate mounting brackets for the pivot links 40, 50, and the like.

Each of the horizontal plates 63 of the mechanisms 30*a*, 30*b* overlies and is secured to the lateral edges of a shim plate 80 (FIGS. 6 and 7), which extends between the mechanisms 30*a*, 30*b* to provide stability and uniformity of motion. The shim plate 80 includes a contact surface 81 that is fixed to the underside of the horizontal plate 63 of the table surface mounting bracket 60 by a pair of rivets 72 which are inserted through apertures 84 in the shim plate 80 and through the pair of apertures 65 in the mounting bracket horizontal plate 63. The contact surface 81 merges at its forward edge with a downwardly sloping transition surface 82, which then merges at its forward edge with a horizontal spacing surface 83. The spacing surface 83 includes a rivet aperture 85 on each lateral edge for receiving a rivet assembly 110. A vertical flange 86 originates at the forward edge of the spacing surface 83 and extends upwardly to rest against the underside of the mounted bracket horizontal plate 63.

The table surface mounting bracket horizontal portions 63 of the mechanisms 30*a*, 30*b* are also each secured beneath each of a pair of a swivel units 90*a*, 90*b*. These swivel units are mirror images of one another about the plane of symmetry P. Accordingly, only the swivel unit 90*a* will be described in detail herein; those skilled in this art will appreciate that the description is equally applicable to the swivel unit 90*b* .

The swivel unit 90*a* (FIGS. 4 through 7) comprises a collar 91 and a rivet pin assembly 110. The collar 91 has a lower surface 92 which includes a central aperture 97. The collar 91 further includes a forward extension tab 93 fixed to its forward portion and a rear extension tab 94 fixed to its rear portion. The forward extension tab 93 has a forward stop edge 95 that extends substantially radially from the aperture 95. Similarly, the rear extension tab 94 has a rear stop edge 96 extending substantially radially from the aperture 95. Each of the stop edges 95, 96 is positioned from the aperture 97 to contact the stop pin 69 as the collar 91 rotates about the rivet pin assembly 110. The lower surface 92 merges at its inward edge to a sloped surface 98, which then merges into a horizontal inward upper surface 100; similarly, the lower surface 92 merges at its outward edge to a sloped surface 99 which then merges into a horizontal lateral upper surface 101. The upper surfaces 100, 101 are separated in elevation from the lower surface 92 sufficiently to clear the stop pin 69 as the collar 91 rotates. The upper surfaces 100, 101 of the swivel unit 90*b* are fixed to a spacer block 120 via a quartet of threaded fasteners 103, which are inserted through apertures 102. The spacer block 120 is in turn fixed to the underside of the upper table surface 140. The spacer block 120 or other spacing means should be sized so that the upper table surface can rotate without interference from the lower table surface 130; i.e., it should be at least as thick as, and preferably is slightly thicker than, the lower table surface 130. In contrast, the swivel unit 90*b* is fixed directly to the underside of the lower table surface 130 via a similar quartet of fasteners 103 and apertures 102.

The rivet assembly 110 (FIGS. 6 and 7) comprises a rivet 111 having a head 112 that rests atop and adjacent the lower surface 92 of the collar 91, and a shank 113 that extends sequentially through the apertures 97, 89 and 85, and further comprises a sleeve 117 that receives the rivet shank 113. The sleeve 117 is positioned between the horizontal plate 63 and the spacing surface 83 and provides strength therebetween. The shaft 113, which extends through the center of the sleeve 117, includes a tenon 118 that protrudes into and fills the aperture 85; the press-fit (or other securing means) between the tenon 118 and the aperture 85 fixes the shank 113 to provide an axis of rotation $A_1$ (shown in FIG. 3), which extends through the center of the shank 113 and through the collar 91 of the swivel unit 90*a*. The axis of rotation $A_1$ is substantially normal to the table surface 140 and to the underlying surface. Similarly, an axis of rotation (not shown) extends through the shank 113 and the collar 91 of the swivel unit 90*b* so as to be substantially normal to the table surface 130 and the underlying surface. Those skilled in this art will appreciate that, although the illustrated swivel unit is preferred, any swivel unit that permits rotation of the table surfaces 130, 140 about an axis substantially normal thereto, such as one having rotating ball bearings, a rotating spindle, or another known configuration, is suitable for use with this invention.

The lower table surface 130 is substantially planar. The lower surface underside 131 abuts and is attached at a forward corner (shown in FIG. 8 as the lower left corner) to the inward and lateral upper surfaces 100, 101 of the swivel unit 90*b*. The lower table surface 130 also includes an upper surface 133. The lower table 130 is substantially rectangular, but the forward corner opposite the corner attached to the swivel unit 90*b* is cut out; the cutaway portion 132 is sufficient in size that the lower table surface 130 avoids contact with the swivel unit 90*a* as the lower table surface 130 moves to and from its unrotated position (i.e., the position shown in FIG. 8).

The upper table 140 comprises a substantially rectangular plane having an underside 141, to which the spacer block 120 is attached, and a visible upper surface 142. As the upper table surface 140 is the top, and therefore more often visible, surface of the table 20, particularly when the table surfaces 130, 140 are in their retracted positions, preferably the upper surface 142 is decoratively finished.

Although both the upper and lower tables 130, 140 are illustratively and preferably generally rectangular, those skilled in this art will appreciate that the tables 130, 140 can take any generally planar shape, such as oval, square, circular, triangular, and the like, and still be suitable for use with the present invention, as long as the lower table 130 includes a cutaway portion or some other means for avoiding interference with the swivel unit 90*a* and the spacer block 120. It is preferred that the tables 130, 140 be elongated (i.e., having a first length dimension that is greater than a perpendicular second width dimension) such as rectangular, oval, oblong, and the like, so that as each rotates about its respective axis of rotation, each can provide a support surface in different locations relative to the base 21. Further, the tables could be mounted at the same height on their respective swivels if the tables were sized and configured so as not to interfere with one another during rotation. For example, each table could, in the retracted position, extend inwardly only to the plane of symmetry P; if this configuration were employed, the usable width of each table could be increased by including for each table a second table layer hinged at its lateral edge to fold upon and overlie the table in the retracted position. In addition, the table surfaces 130, 140 could be mounted to the swivel units 90*a*, 90*b* at their respective rear corners or at other positions; however, mounting to the forward corners of the table surfaces 130, 140, so that the table surfaces 130, 140 rotate with their respective rear edges moving laterally and forwardly from the unrotated extended positions to the laterally extended positions, is preferred.

Figures 3, 4:
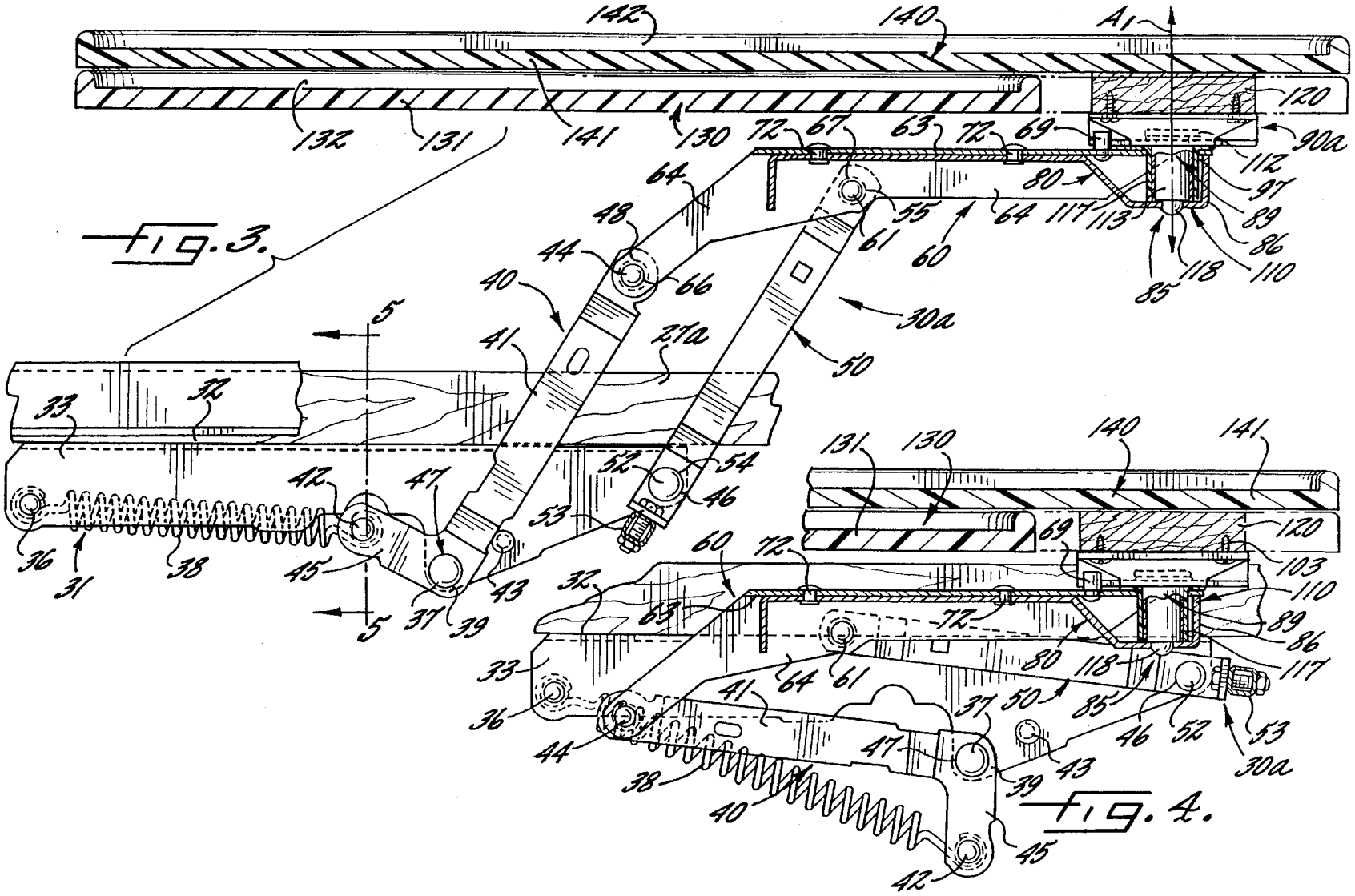
FIG. 3 is a cross-sectional side view of the table of FIG. 1 with the table surfaces in their respective unrotated extended positions.
FIG. 4 is a cross-sectional side view of the table of FIG. 1 with the table surfaces in the retracted position.
Figures 6, 7:
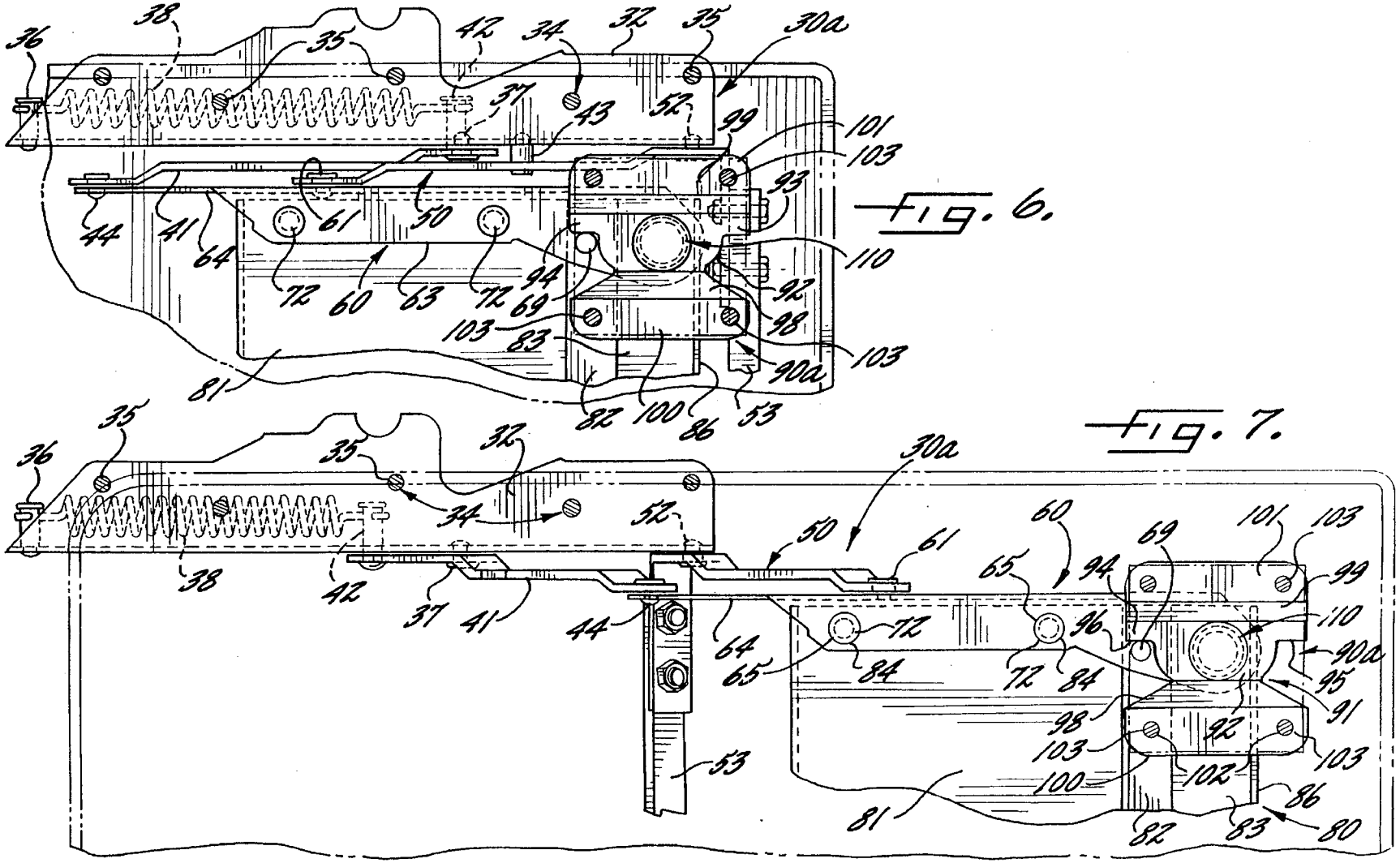
FIG. 6 is an enlarged top view of a table surface in its retracted position.
FIG. 7 is an enlarged top view of the table surface of FIG. 6 in its unrotated extended position.

In operation, the table 20 begins in the retracted position illustrated in FIGS. 1, 4, and 6. In the retracted position, the table surfaces 130, 140 are generally horizontally disposed and are positioned generally above the base footprint defined by the horizontally-disposed periphery of the base 21, with the lower table surface 130 resting atop the front, lateral and rear walls 22, 23*a*, 23*b*, 25 of the base 21. For each of the mechanisms 30*a*, 30*b*, the spring extension arm 45 of the rear pivot link 40 extends downwardly from the pivot pin 37, and the body link 41 of the rear pivot link 40 extends rearwardly and slightly upwardly from the pivot pin 37 to the pivot pin 44. In this position the spring 38 is extended; the tension in the spring 38 (other suitable biasing means) biases the table surfaces 130, 140 toward the extended positions. The front pivot link 50 extends rearwardly and slightly upwardly from aperture 54 to aperture 55; the front pivot link 50 is substantially parallel to the body link 41 of the rear pivot link 40.

In addition, the mechanisms 30*a*, 30*b* are sufficiently compact that they are able to fit within the periphery of the base 21. Preferably, in the closed position, the horizontal distance between the pivot pin 52 and the pivot pin 44 is between about 14 and 18 inches. As used herein, horizontal distance means the forward-to-rearward distance between these pivots measured parallel to the table surfaces 130, 140. In this configuration, the mechanism can close sufficiently compactly that most of the cavity of the base 21 can be used for storage.

To move the table surfaces 130, 140 from the retracted position of FIGS. 1, 4, and 6 to their respective unrotated extended positions, an upwardly and forwardly-directed force is applied to the table surfaces 130, 140. As the table surfaces 130, 140 rise in response to such a force, the attached swivel units 90*a*, 90*b* and the table surface mounting brackets 60 also rise. Ascension of the table surface mounting brackets 60 causes each of the front pivot links 50 to rotate about the pivot pins 52 so that the end of each front pivot link 50 interconnected with a table surface mounting bracket 60 by pivot pin 61 moves upwardly and forwardly. Simultaneously, each of the rear pivot links 40 rotates about a pivot pin 37 so that the end of its body link 41 that is interconnected with a table surface mounting bracket 60 via a pivot pin 44 moves upwardly and forwardly. The table surfaces 130, 140 reach their maximum height as the body links 41 of the rear pivot links 40 and the front pivot links 50 are disposed vertically. The table surfaces 130, 140 then continue slightly downwardly and forwardly, still controlled by the action of the rear and front pivot links 40, 50. Movement of the mechanisms 30*a*, 30*b* and the table surfaces 130, 140 ceases as the front pivot links 50 strike their respective stop pins 43. The table surfaces 130, 140 remain in a stacked configuration.

Movement of the table surfaces 130, 140 to their unrotated extended positions is aided by the tension present in each of the extended springs 38, which urge the forward spring pins 42 toward their respective rear spring pins 36, and thereby assist the extension of the rear pivot link 40. Assistance of this action can be particularly helpful to a frail operator of the unit, as the table surfaces 130, 140 can be quite heavy in some embodiments.

In their unrotated extended positions (FIGS. 3, 7, and 8), the table surfaces 130, 140 have moved upwardly and forwardly from their respective positions above the base footprint to positions wherein their major portions (i.e., more than half of the table surfaces 130, 140) are positioned above and forwardly of the base 21 and inwardly from the periphery of the base footprint. The table surfaces 130, 140 should be configured and sized so that in the unrotated extended position, the table surfaces 130, 140 provide convenient and comfortable support surfaces for occupants of adjacent seating units without any adjustment of the base 21 of the table 20 relative to the floor. This should be the case for different styles and types of seating units, including both seating units that include armrests and those that do not. Preferably, in the extended position, the table surfaces 130, 140 will be displaced between about 8 and 12 inches upwardly and about 12 and 16 inches forwardly relative to the base 21 from their locations in the retracted position.

It is noteworthy that, in illustrated embodiment, when viewed in side elevation (as in FIGS. 3 and 4), the pivot pins 37, 44, 61 and 52 are positioned on the base mounting bracket 31 and the table surface mounting bracket 60 so that in the unrotated extended position, the retracted position, and all intermediate positions therebetween, line segments drawn between adjacent pivot pins (i.e., from pivot pins 37 to 44, 44 to 61, 61 to 52, and 52 to 37) form a parallelogram. This parallelogramatic configuration enables the table surfaces 130, 140 to maintain a substantially horizontal disposition while traveling between the retracted and extended positions. As used herein, a "substantially horizontal disposition" of a table surface means that the table surface varies from the horizontal plane defined by the floor by no more than about 5 degrees. Those skilled in this art will appreciate that slight adjustment of the positions of the apertures on the table surface mounting brackets 60, the base mounting brackets 31, the front pivot links 50, and the rear pivot links 40 can produce a four-bar linkage which causes the table surfaces 130, 140 to vary slightly from horizontal during operation but still maintain a substantially horizontal disposition. Thus, although a substantially parallelogramatic configuration of a four bar linkage is illustrated herein, the invention encompasses any four-bar linkage means that allows the table surfaces 130, 140 to maintain a substantially horizontal disposition when travelling between the retracted and the unrotated extended positions. Those skilled in this art will also appreciate that a mechanism can be constructed that does not allow maintenance of a horizontal disposition by each of the table surfaces during movement between the retracted and the unrotated extended positions, but which does provide that the table surfaces are horizontally disposed in the retracted and unrotated extended positions, although this is generally less preferred.

Figure 2:
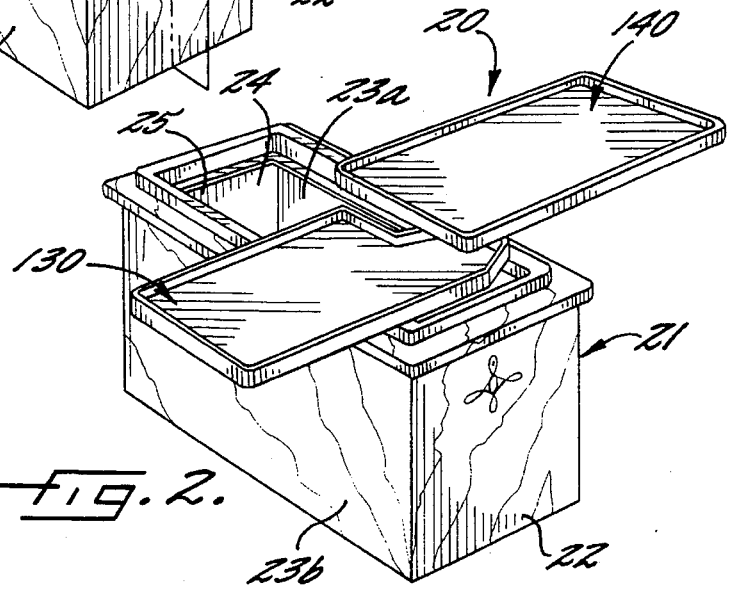
FIG. 2 is a perspective view of the table of FIG. 1 with the table surfaces in their respective laterally extended positions.
Figure 5:
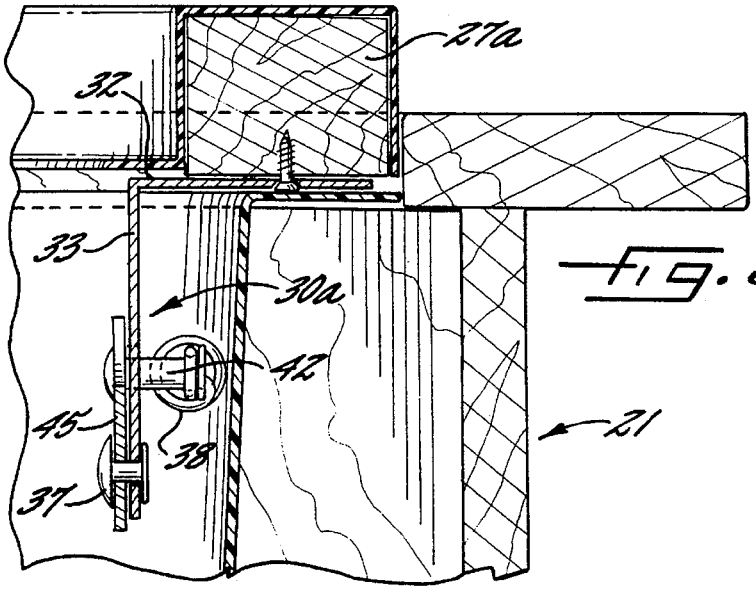
FIG. 5 is a cross-sectional end view taken along line 5—5 of FIG. 3 showing the attachment of the storage bin to the table base.
Figure 8:
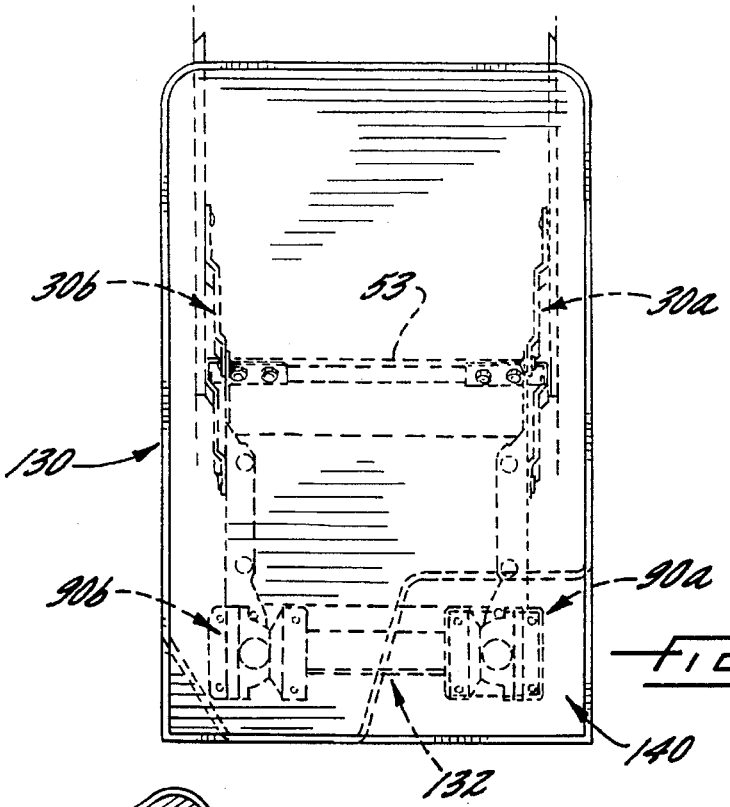
FIG. 8 is a top view of the table of FIG. 1 with the table surfaces in their respective extended, rotated positions.
Figure 9:
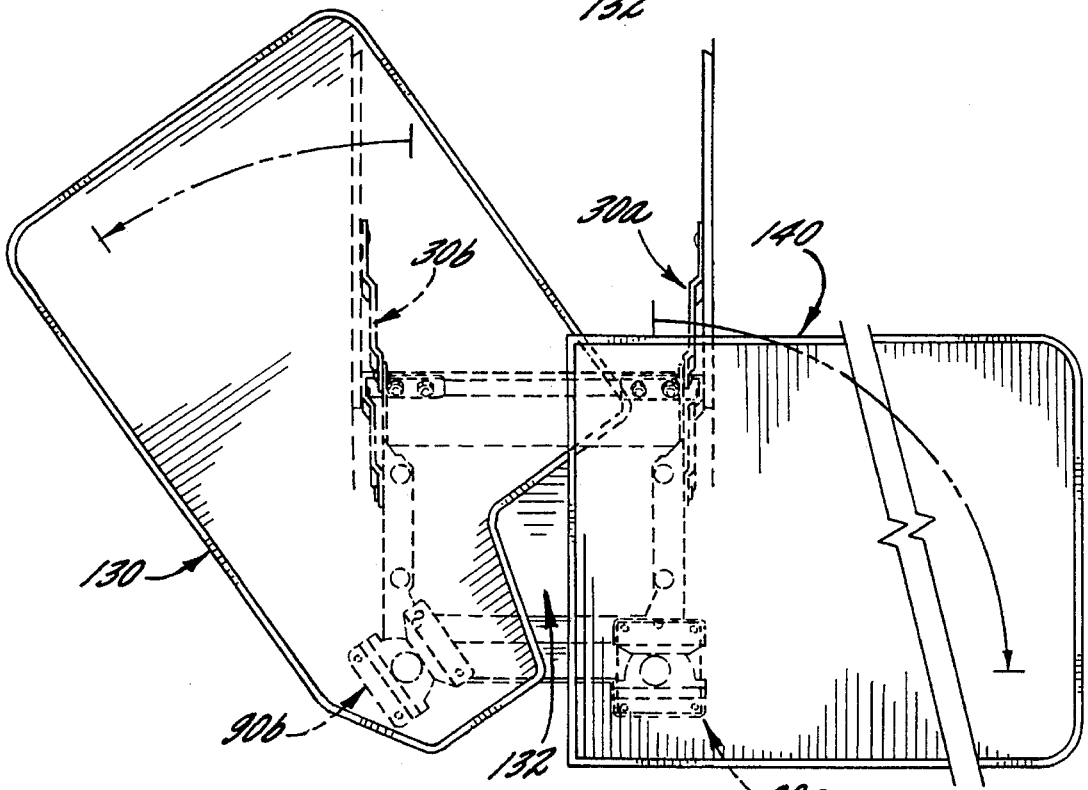
FIG. 9 is a top view of the table of FIG. 1 with one table surface in its laterally extended position and with the other table surface moving to its laterally extended position from its retracted position.

From their unrotated extended positions shown in FIGS. 3, 7, and 8, the table surfaces 130, 140 can then be rotated to their respective laterally extended positions (FIGS. 2 and 9). A laterally directed force applied to the rearward edge of the table surface 140 causes the table surface 140 to pivot about the axis of rotation $A_1$ so that the rearward edge of the table surface 140 moves forwardly and laterally (illustrated as a clockwise movement in FIG. 9). This rotation is controlled by the swivel unit 90*b;* the collar 91 rotates about the shank 113, which remains stationary relative to the collar 91, in response to the movement of the table surface 140. The rotational plane of the table surface 140 is substantially coplanar with the upper surface 133 and substantially normal to the axis of rotation $A_1$. Rotation of the table surface 140 can continue until the table surface 140 reaches the laterally extended position shown in FIG. 2. From this position, a forwardly directed force applied to the rearward edge of the table surface 140 causes the table surface 140 to pivot to the forwardly extended position shown in FIG. 10, in which the table surface 140 has pivoted between about 150° and 190°, and preferably approximately 180 degrees, from the unrotated extended position of FIG. 8. The rotation of the table surface 140 ceases as the front stop edge 96 of the front stop pin 94 strikes the stop pin 69.

Figure 10:
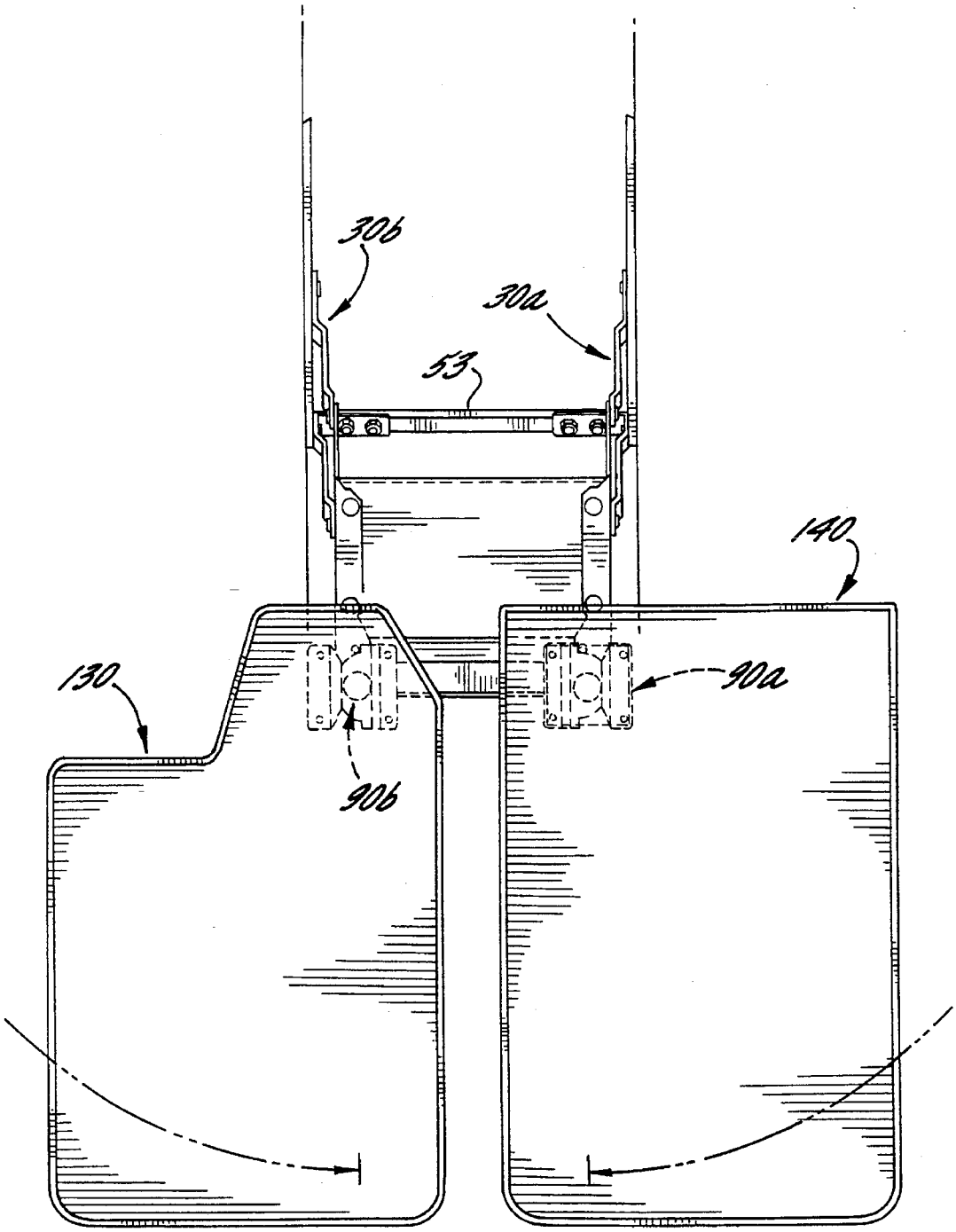
FIG. 10 is a top view of the table of FIG. 1 with the table surfaces in their respective forwardly extended positions.
Figure 11:
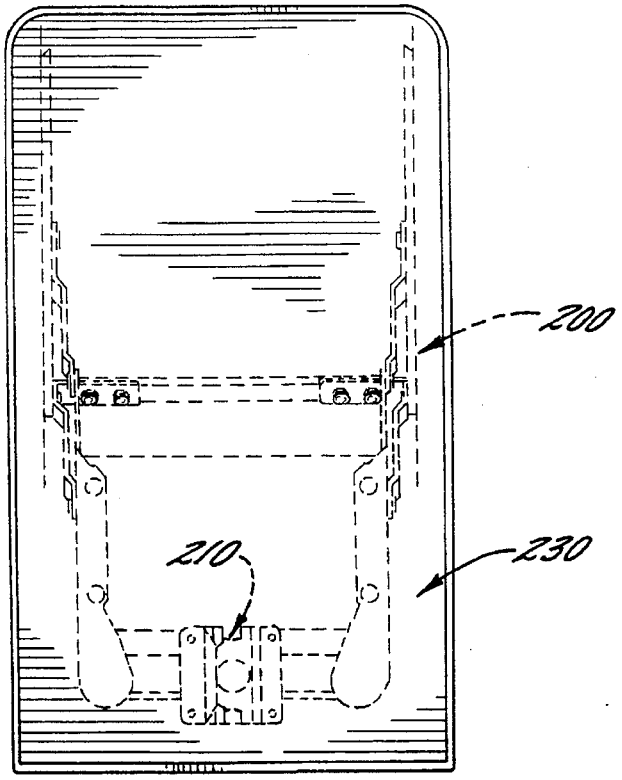
FIG. 11 is a top view of a table having a pair of table surfaces with coincident axes of rotation.
Figure 12:
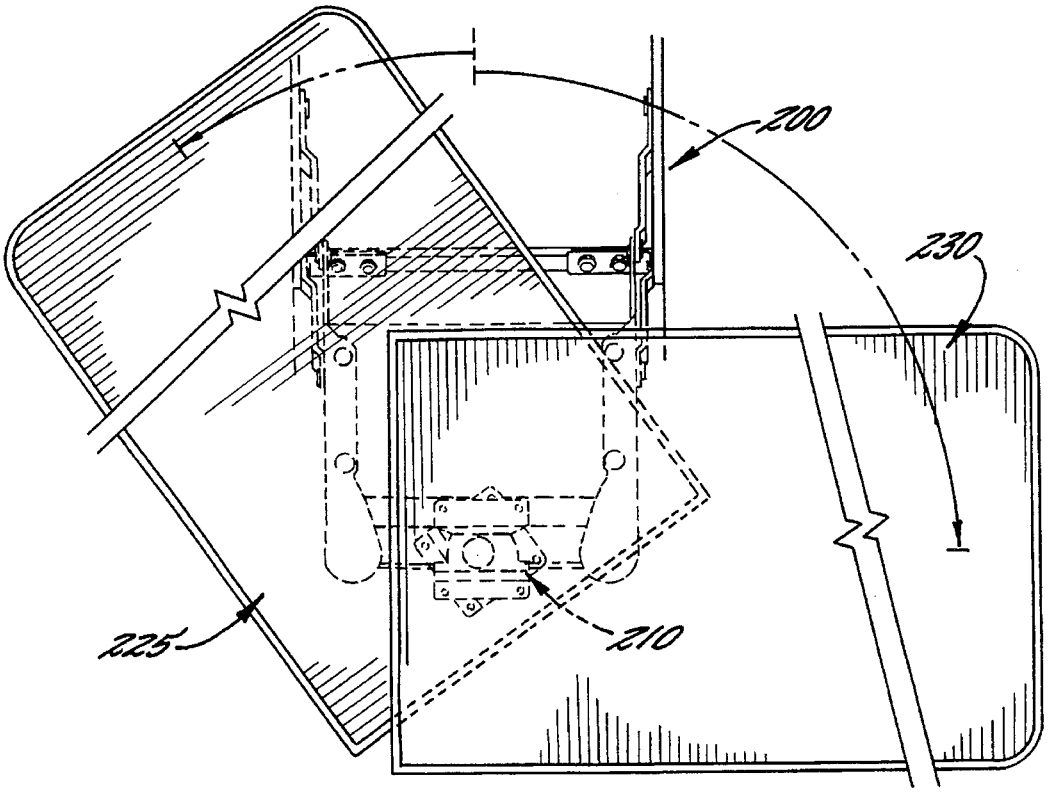
FIG. 12 is a top view of the table of FIG. 11 with one table surface in its laterally extended position and with the other table surface moving to its laterally extended position from its retracted position.
Figure 13:
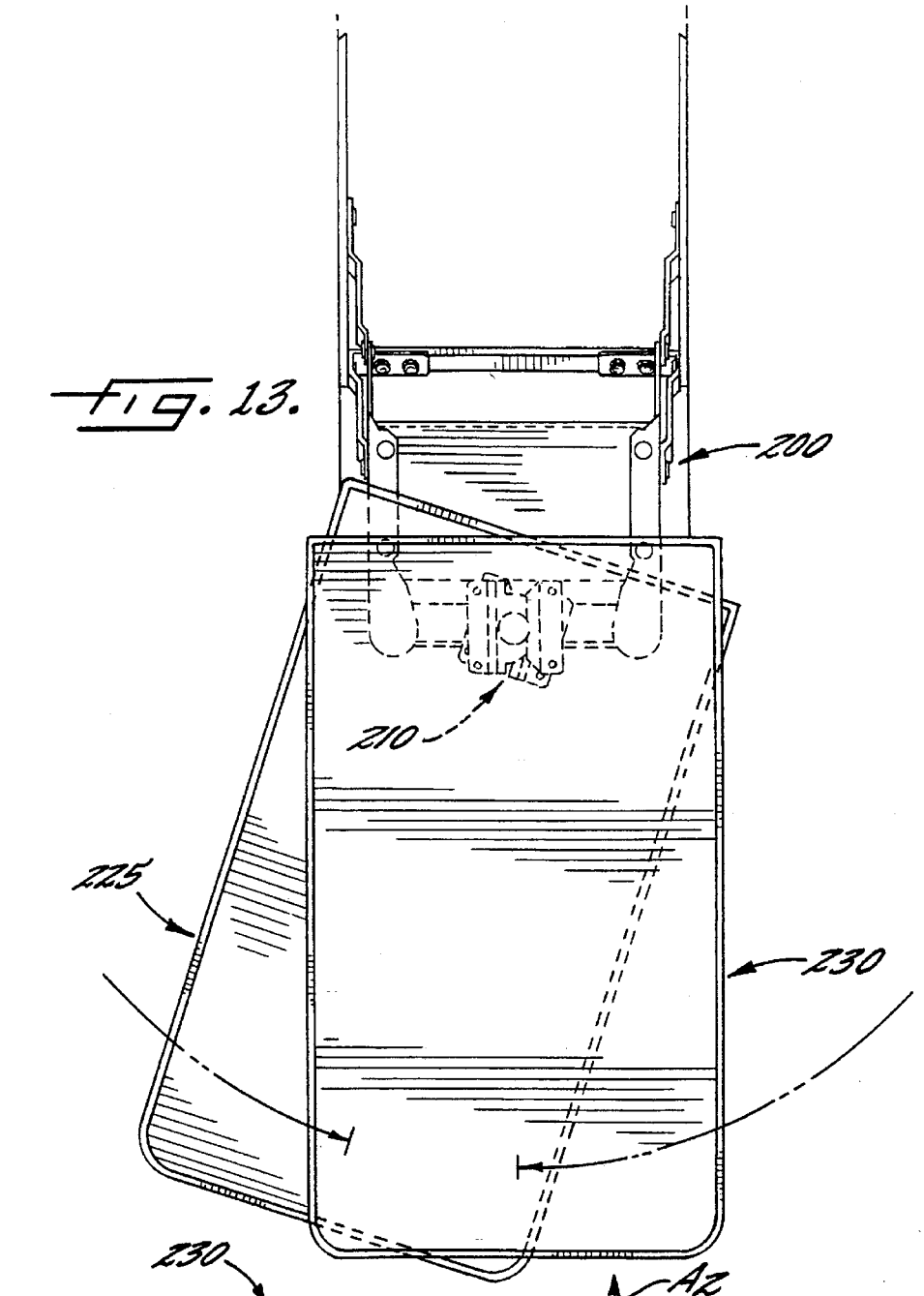
FIG. 13 is a top view of the table of FIG. 11 with one table surface in its forwardly extended position and with the other table surface moving to its forwardly extended position from its laterally extended position.
Figure 14:
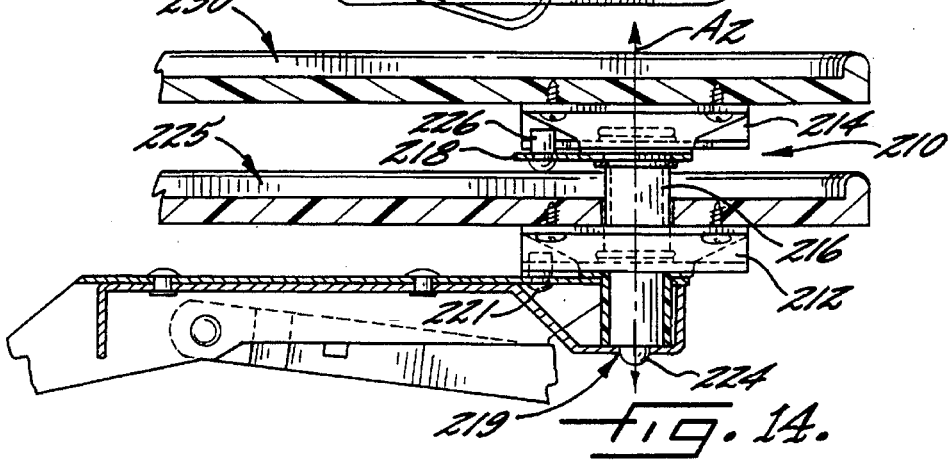
FIG. 14 is an enlarged cross-sectional side view of the table of FIG. 11.

Those skilled in this art will appreciate that the table surface 130 can be rotated to its laterally extended and forwardly extended positions in the same manner as the table surface 140 except that the table surface 130 rotates in the opposite direction (counterclockwise as seen in FIG. 9) and it rotates in a rotational plane that is slightly below that of the table surface 140. It is preferred that, as illustrated in FIG. 10, the table surface 130 does not underlie the table surface 140 in the forwardly extended position, as this configuration maximizes the surface area of upper surfaces 133, 143 available for supporting items placed thereon. It is also preferred that, as illustrated, the swivel units 90*a*, 90*b* are configured so that the table surfaces 130, 140 are able to swivel independently.

When the table surfaces 130, 140 are in their respective laterally extended positions, they are positioned so that the major portion of each table surface 130, 140 is forward, above, and lateral of the base footprint, thereby providing a support surface for an occupant of an adjacent seating unit, such as a chair, at a height and in a position that is comfortable and convenient. Preferably, the table surfaces take laterally extended positions in lateral directions that are generally opposed to one another. Typically, the height of the table surfaces 130, 140 is between about 16 and 24 inches above the underlying surface; thus, the mechanisms 30*a*, 30*b* and the base 21 should be configured so that the table surfaces 130, 140 are so positioned. Also, it is generally preferred that the swivel units 90*a*, 90*b* be attached to the table surfaces 130, 140 so that their respective axes of rotation $A_1$, $A_2$ are eccentric relative to their respective table surfaces; i.e., they should be interconnected so that each axis of rotation does not extend through the center of the table surface. Eccentric mounting of the swivel units 90*a*, 90*b* enables the table surfaces 130, 140 to extend a greater distance from the base 21, with the result that a greater portion of each table surface is positioned in front of and therefore is accessible to the seating unit occupant. More particularly, it is preferred that the swivel units 90*a*, 90*b* be mounted so that each of the axes of rotation of the table surfaces 130, 140 are offset in both the lateral and forward directions; in a particularly preferred embodiment, the axes of rotation are offset forwardly between 4 and 8 inches and laterally between 1 and 4 inches from the table surface center.

From the forwardly extended positions (FIG. 10), the table surfaces 130, 140 can be returned to their respective laterally extended, unrotated extended, and retracted positions simply by reversing the forces applied thereto described above. Rotation of the table surfaces 130, 140 ceases when the rear stop edge 96 of the rear extension tab 95 strikes the stop pin 69. Notably, in the unrotated extended and retracted positions, the swivel unit 90*b*, including the spacer 120, resides within the space defined by the cutaway portion 132.

An additional embodiment of the present invention is illustrated in FIGS. 11 through 14. A mechanism 200 has pairs of base mounting brackets, front pivot links, rear pivots links, and table mounting brackets and a shim plate that extends between the table mounting brackets that are virtually identical to those illustrated in FIGS. 1 through 10. A dual swivel unit 210 is attached to the forward center portion of the shim plate. The dual swivel unit comprises a lower collar 212, an upper collar 214, a shaft 216, and an upper plate 218. A tenon 224 protrudes from the lower end of the shaft 216 and rests within an aperture 219 in the shim plate. A stop pin 221 extends upwardly from the shim plate 219 beneath the lower collar 212. A lower table 225 having an aperture through which the shaft 216 extends resides above the lower collar 212 and beneath the upper plate 218 and is fixed to the lower collar 212. The upper collar 214 resides above the upper plate 218, from which a stop pin 226 extends upwardly beneath the upper collar 214. The upper collar is fixed to the underside of an upper table 230.

The extension and rotation of the table surfaces 225, 230 is carried out in essentially the same fashion as that described above for the embodiment of FIGS. 1 through 10. The tables begin in a retracted position (not shown), then are moved to an unrotated extended position (FIG. 11) and to laterally (FIG. 12) and forwardly extended (FIG. 13) positions through the application of forces to the table surfaces 225, 230 as described above. However, the table surfaces 225, 230 each rotate to the laterally and forwardly rotated positions about axes of rotation (shown as $A_2$ in FIG. 14) that are substantially coincident and that are defined by the longitudinal axis of the rivet shaft 216. This configuration enables the lower table surface 225 to be constructed without a cutaway portion such as that included in the table surface 130 shown in FIG. 8.

Figure 15:
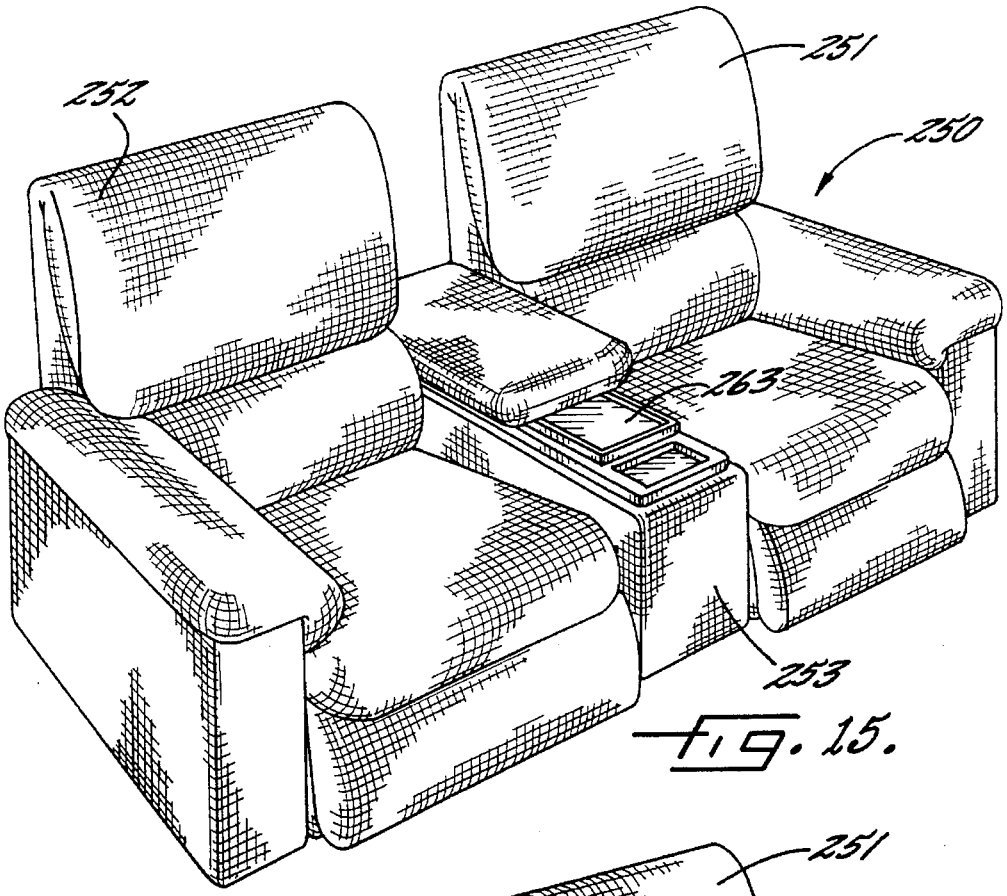
FIG. 15 is a perspective view of a furniture unit having a pair of recliner chairs with a console table therebetween in which the console table is shown in its retracted position.
Figure 16:
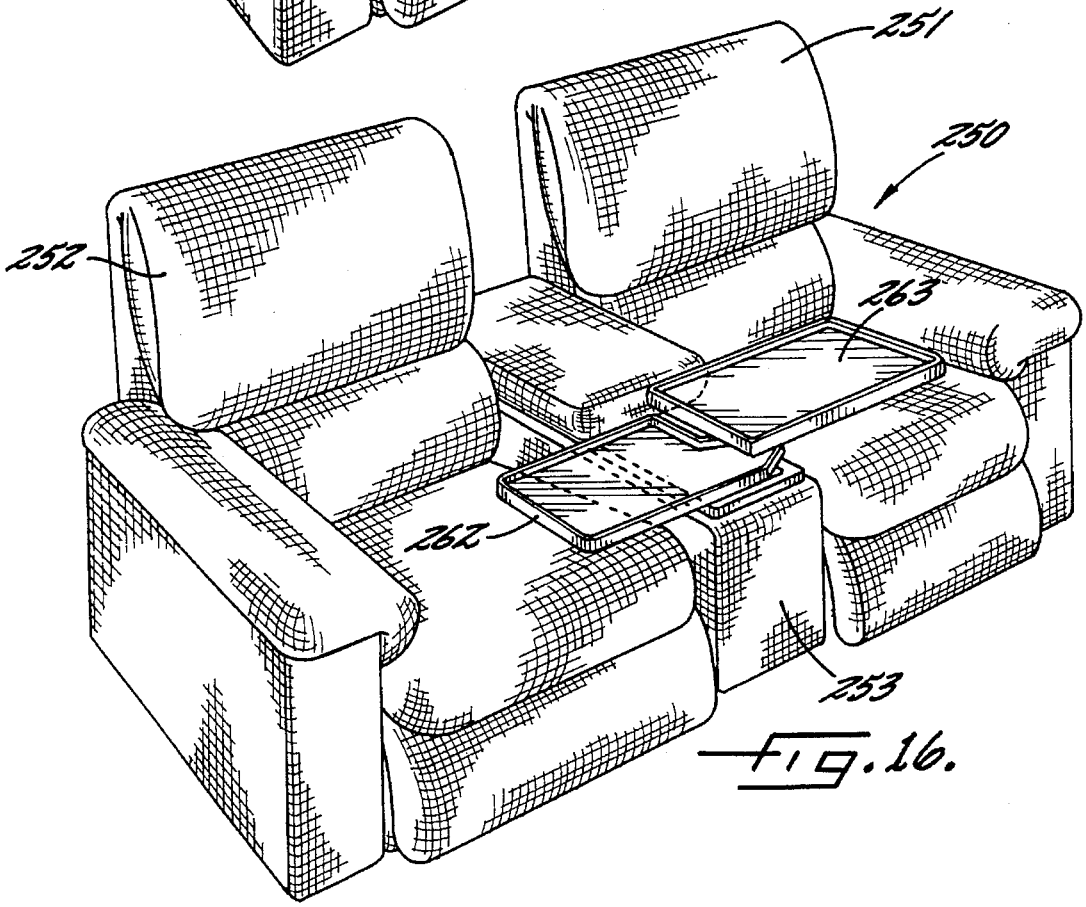
FIG. 16 is a perspective view of the furniture unit of FIG. 15 with its table surfaces in their respective laterally extended positions.

Either of these mechanism and table embodiments or their equivalents can be used with the "side-by-side" seating unit 250 illustrated in FIGS. 15 and 16. This unit, an exemplary embodiment of which is described in U.S. Pat. No. 5,106,153 to Durling, comprises a pair of recliner chairs 251, 252 having a console 253 attached therebetween. A cover 261 is hingedly attached to the top rear edge of the console 253. A mechanism (not shown) of the configuration illustrated in FIGS. 1 through 10 is pivotally attached to the console 253 and to a lower table 262 and an upper table 263; these tables, controlled by the mechanism, move between retracted, unrotated extended, laterally extended, and forwardly extended positions as described above.

The use of the mechanism with the side-by-side seating unit 250 is particularly advantageous in that, because the chairs 251, 252 are fixed to the console 253, the table surfaces and mechanism can be sized and positioned to provide the most convenient table surface for an occupant of either of the chairs. It should be understood that the mechanism and table surfaces can be added to an intact side-by-side furniture unit or can be attached to one or two separate seating units through some attachment means, such as mating mounting brackets, mounting posts, screws or bolts, panels, and the like. The capability of attaching separate console and seating units provides the user with many options. Chairs can be attached and detached as the user desires or as available living space permits. Different chairs, which may differ in style, structure, and appearance, can be attached to the same console unit. Moreover, shipping of matching units is simplified because the bulkiness of the already constructed side-by-side unit has been reduced to that of a typical seating unit.

Although the illustrated recliner chairs are preferred, those skilled in this art will appreciate that this mechanism and table can also be used in conjunction with other seating units having a pair of chairs sandwiching a console, such as those disclosed in U.S. Pat. No. 5,064,244 to Spoule, U.S. Pat. No. 4,986,589 to McNew, U.S. Pat. No. 4,685,729 to Heesch et al., U.S. Pat. No. 2,859,803 to McAllister, and U.S. Pat. No. 3,632,157 to Lohr. Further, the mechanism and table combination can be used advantageously in conjunction with other seating units, such as those found in an airplane, an automobile or van, a bus, a locomotive, or a subway train, that are positioned in pairs and that are typically fixed relative to their underlying surface.

The foregoing embodiments are illustrative of the present invention, and are not to be construed as limiting thereof. The invention is defined by the following claims, with equivalents of the claims to be included therein.

That which is claimed is:

1. A table comprising:

a base having a horizontally disposed periphery, the horizontally-disposed periphery defining a footprint on an underlying surface;

first and second generally planar table surfaces;

table surface forward extension means interconnected with said base and said first and second table surfaces;

table surface lateral extension means interconnected with said base and said first and second table surfaces;

said table surface forward extension means and said table surface lateral extension means each being constructed and arranged so that each of said first and second table surfaces is movable between a retracted position, in which said first and second table surfaces are positioned generally above the base footprint, and a laterally extended position, in which major portions of said first and second table surfaces are generally horizontally disposed and are positioned above, forwardly and laterally of the base footprint, said table surface lateral extension means being configured and arranged so that, in the laterally extended position, said major portion of said first table surface is positioned above, forward, and lateral of said base in a first lateral direction, and said second table surface is positioned above, forward, and lateral of said base in a second lateral direction, said second lateral direction being opposite said first lateral direction, wherein said table surface lateral extension means is configured so that said first and second table surfaces are movable to an extended unrotated position, in which said first and second table surfaces are generally horizontally disposed and in which said major portions of said first and second table surfaces are positioned forwardly and above said base and inwardly from the base footprint, and wherein said table lateral extension means comprises:

first swivel means interconnected with said first table surface and with said table surface extension means for swiveling said first table surface relative to said table surface extension means about a first axis of rotation, which first axis of rotation is generally orthogonal to said first table surface, between its unrotated extended position and its laterally extended position; and second swivel means interconnected with said second table surface and with said table surface extension means for swiveling said second table surface relative to said extension means about a second axis of rotation, which second axis of rotation is generally orthogonal to said second table surface and substantially parallel to the first axis of rotation, between its unrotated extended position and its laterally extended position.

2. The table defined in claim 1, wherein said first and second swivel means are configured and attached to said first and second table surfaces and said extension means so that said first and second table surfaces independently rotate between their respective unrotated extended positions and their respective laterally extended positions.

3. The table defined in claim 1, wherein said first and said swivel means are configured so that said first and second table surfaces rotate to a forwardly rotated position, in which said first and second table surfaces are rotated between about 150 and 190 degrees from their respective unrotated extended positions.

4. The table defined in claim 1, wherein said first swivel means includes stop means for ceasing the rotation of said first table surface as said first table surface reaches its forwardly extended position, and wherein said second swivel means includes stop means for ceasing the rotation of said second table surface as it reaches its forwardly extended position.

5. The table defined in claim 1, wherein in the retracted position, said first and second table surfaces are generally horizontally disposed.

6. The table defined in claim 5, wherein said table surface forward extension means and said table surface lateral extension means are configured so that said first and second table surfaces maintain a generally horizontal disposition as each moves between their respective retracted, unrotated extended, and laterally extended positions.

7. The table defined in claim 1, wherein said second table surface is positioned above said first table surface.

8. The table defined in claim 1, wherein said first swivel means and said second swivel means are attached to said table surface forward extension means so that said first axis of rotation and said second axis of rotation do not coincide.

9. The table defined in claim 1, wherein said first swivel means and said second swivel means are attached to said table surface extension means so that said first axis of rotation and said second axis of rotation are substantially coincident.

10. The table defined in claim 1, wherein said first swivel means is attached to said first table surface so that the first axis of rotation is forwardly and laterally offset in a first lateral direction from the center of said first table surface when said first table surface is in its unrotated extended position.

11. The table defined in claim 1, wherein said first table surface is generally elongated.

12. The table defined in claim 10, wherein said second swivel means is attached to said second table surface so that the second axis of rotation is forwardly and laterally offset in a second lateral direction from the center of said second table surface when said second table surface is in its unrotated extended position, said second lateral direction being generally opposite said first lateral direction.

13. The table defined in claim 12, wherein said second table surface is generally elongated.

14. The table defined in claim 1, wherein said extension means is configured so that, in the extended position, said first table surface is positioned between about 16 and 24 inches above the underlying surface.

15. The table defined in claim 1, wherein said base includes a storage cavity positioned beneath said first and second table surfaces when said first and second table surfaces are in the retracted position, the cavity being accessible from above when said first and second table surfaces are in their respective unrotated extended positions.

16. The table defined in claim 1, wherein said base includes a first lateral portion and further comprises first means for attaching a first chair to said base first lateral portion.

17. The table defined in claim 16, wherein said base further comprises second means for attaching a second chair to a second lateral portion opposed to said first lateral portion of said base second attaching means first lateral portion.

18. The table defined in claim 17, in combination with a pair of chairs, each of which is attached to a respective one of said first and second attaching means so that said base is positioned between said pair of chains.

19. A unit of furniture comprising:

a pair of chairs; and a table comprising:

a base having a pair of lateral portions, each of which is attached to one of said pair of chairs so that said base is positioned said pair of chains, said base having a horizontally-disposed periphery that defines a footprint on an underlying surface;

first and second generally planar table surfaces;

table surface forward extension means interconnected with said base and said first and second table surfaces;

table surface lateral extension means interconnected with said base and said first and second table surfaces;

said table surface forward extension means and said table surface lateral extension means each being constructed and arranged so that each of said first and second table surfaces is movable between a retracted position, in which said first and second table surfaces are positioned generally above the base footprint, and a laterally extended position, in which major portions of said first and second table surfaces are generally horizontally disposed and are positioned above, forwardly and laterally of the base footprint, said table surface lateral extension means being configured and arranged so that, in the laterally extended position, said major portion of said first table surface is positioned above, forward, and lateral of said base in a first lateral direction, and said second table surface is positioned above, forward, and lateral of said base in a second lateral direction, said second lateral direction being opposite said first lateral direction, wherein said table surface lateral extension means is configured so that said first and second table surfaces are movable to an extended unrotated position, in which said first and second table surfaces are generally horizontally disposed and in which said major portions of said first and second table surfaces are positioned forwardly and above said base and inwardly from the base footprint, and wherein said table lateral extension means comprises:

first swivel means interconnected with said first table surface and with said table surface extension means for swiveling said first table surface relative to said table surface extension means about a first axis of rotation, which first axis of rotation is generally orthogonal to said first table surface, between its unrotated extended position and its laterally extended position; and second swivel means interconnected with said second table surface and with said table surface extension means for swiveling said second table surface relative to said extension means about a second axis of rotation, which second axis of rotation is generally orthogonal to said second table surface and substantially parallel to the first axis of rotation, between its unrotated extended position and its laterally extended position.

20. The unit of furniture defined in claim 19, wherein said first and second swivel means are configured and attached to said first and second table surfaces and said extension means so that said first and second table surfaces independently rotate between their respective unrotated extended positions and their respective laterally extended positions.

21. The unit of furniture defined in claim 19, wherein said first and said swivel means are configured so that said first and second table surfaces rotate to a forwardly rotated position, in which said first and second table surfaces are rotated between about 150 and 190 degrees from their respective unrotated extended positions.

22. The unit of furniture defined in claim 19, wherein said first swivel means includes stop means for ceasing the rotation of said first table surface as said first table surface reaches its forwardly extended position, and wherein said second swivel means includes stop means for ceasing the rotation of said second table surface as it reaches its forwardly extended position.

23. The unit of furniture defined in claim 19, wherein in the retracted position, said first and second table surfaces are generally horizontally disposed.

24. The unit of furniture defined in claim 23, wherein said table surface forward extension means and said table surface lateral extension means are configured so that said first and second table surfaces maintain a generally horizontal disposition as each moves between their respective retracted, unrotated extended, and laterally extended positions.

25. The unit of furniture defined in claim 19, wherein said second table surface is positioned above said first table surface.

26. The unit of furniture defined in claim 19, wherein said first swivel means and said second swivel means are attached to said table surface forward extension means so that said first axis of rotation and said second axis of rotation do not coincide.

27. The unit of furniture defined in claim 19, wherein said first swivel means and said second swivel means are attached to said table surface extension means so that said first axis of rotation and said second axis of rotation are substantially coincident.

28. The unit of furniture defined in claim 19, wherein said base includes a storage cavity positioned beneath said first and second table surfaces when said first and second table surfaces are in the retracted position, the cavity being accessible from above when said first and second table surfaces are in their extended positions.

29. The unit of furniture defined in claim 19, wherein each of said pair of chairs further comprises reclining means for moving said chair from an upright position to one or more reclined positions.

30. The unit of furniture defined in claim 19, wherein said base further comprises first and second means for releasably securing each of said pair of chairs to said first and second base lateral portions.

31. A mechanism for moving a pair of rotatable table surfaces from a retracted upwardly and in a forward direction to an extended position, each of said pair of table surfaces also being independently rotatable in parallel planes substantially orthogonal to the forward direction, said mechanism comprising:

extension means adapted to be attached to a table base for moving the pair of table surfaces between the retracted position, in which the pair of table surfaces are generally horizontally disposed above the table base, and an unrotated extended position, in which the major portion of each of the pair of table surfaces are generally horizontally disposed above and forward of the table base;

first swivel means attached to said extension means and adapted for attachment to a first of the pair of table surfaces for rotation relative to said extension means about a first axis of rotation orthogonal to the planes of rotation;

second swivel means attached to said extension means and adapted for attachment to the second of said pair of table surfaces for rotation relative to said extension means about a second axis of rotation substantially parallel to said first axis of rotation.

32. The mechanism defined in claim 31, wherein said extension means comprises:

means for mounting said mechanism to the table base;

a front pivot link pivotally interconnected with said mounting means at a first pivot;

a rear mounting link pivotally interconnected with said mounting means at a second pivot, said second pivot being located below and rearward of said front pivot link;

swivel mounting means pivotally interconnected with said front and rear mounting links at third and fourth pivots, respectively and further connected with said first and second swivel means.

33. The mechanism defined in claim 31, wherein said first and second swivel means are configured so that the second table surface is disposed directly above the first table surface when both are in their inoperative positions.

34. The mechanism defined in claim 31, wherein said first swivel means and said second swivel means are attached to said extension means so that said first axis of rotation and said second axis of rotation do not coincide.

35. The mechanism defined in claim 31, wherein said first swivel means and said second swivel means are attached to said extension means so that said first axis of rotation and said second axis of rotation coincide.

36. The mechanism defined in claim 31, wherein said extension means is configured so that, in moving from the retracted to the extended position, said swivel mounting means rises between about 8 and 12 inches.

37. A table comprising:

a base having a horizontally disposed periphery, the horizontally-disposed periphery defining a footprint on an underlying surface;

first and second generally planar table surfaces;

table surface forward extension means interconnected with said base and said first and second table surfaces;

first swivel means interconnected with said first table surface and with said table surface extension means for swiveling said first table surface relative to said table surface extension means about a first axis of rotation, which first axis of rotation is generally orthogonal to said first table surface; and second swivel means interconnected with said second table surface and with said table surface extension means for swiveling said second table surface relative to said extension means about a second axis of rotation, which second axis of rotation is generally orthogonal to said second table surface and substantially parallel to the first axis of rotation;

said table surface forward extension means, said first swivel means, and said second swivel means each being constructed and arranged so that each of said first and second table surfaces is movable between a retracted position, in which said first and second table surfaces are positioned generally above the base footprint, and a laterally extended position, in which the major portions of said first and second table surfaces are generally horizontally disposed and are positioned above, forwardly and laterally of the base footprint.

* * * * *

UNITED STATES PATENT AND TRADEMARK OFFICE

CERTIFICATE OF CORRECTION

PATENT NO. : 5,562,049

DATED : October 8, 1996

INVENTOR(S) : Hoffman et al.

It is certified that error appears in the above-identified patent and that said Letters Patent is hereby corrected as shown below:

On the cover page, Item [56], before "Seltzer" insert --Bell,--;

column 4, line 22, after "front wall" insert --22--;

column 5, line 36, after "pivot link" insert --50--.

Signed and Sealed this

Twenty-fifth Day of March, 1997

*Attest:*

*Attesting Officer*

BRUCE LEHMAN

*Commissioner of Patents and Trademarks*